United States Patent [19]

Kaley et al.

[11] Patent Number: 4,932,906

[45] Date of Patent: Jun. 12, 1990

[54] ELECTRICAL CONTACT TERMINAL

[75] Inventors: Robert C. Kaley, Landisville; Robert C. Swengel, Jr., York; James H. Wise, Palmyra, all of Pa.

[73] Assignee: AMP Incorporated, Harrisburg, Pa.

[21] Appl. No.: 376,978

[22] Filed: Jul. 6, 1989

Related U.S. Application Data

[63] Continuation of Ser. No. 285,681, Dec. 16, 1988, abandoned.

[51] Int. Cl.[5] ..... H01R 4/20

[52] U.S. Cl. ..... 439/857; 439/882; 29/863

[58] Field of Search ..... 29/863–866; 439/856, 857, 865–868, 877–882

[56] References Cited

U.S. PATENT DOCUMENTS

| | | | |
|---|---|---|---|
| 2,535,013 | 12/1950 | Freedman | 173/269 |
| 2,704,358 | 3/1955 | Wells . | |
| 3,141,724 | 7/1964 | Raymond | 339/256 |
| 3,295,094 | 12/1966 | Lyon et al. . | |
| 3,521,224 | 7/1970 | Spooren . | |
| 3,538,239 | 11/1970 | Renshaw, Jr. . | |
| 3,699,504 | 10/1972 | Huber . | |
| 3,977,757 | 8/1976 | Yurtin | 339/217 |
| 4,142,771 | 3/1979 | Barnes et al. . | |
| 4,150,355 | 4/1979 | Neff et al. . | |
| 4,371,229 | 2/1983 | Spangler et al. | 439/882 |
| 4,692,122 | 9/1987 | Montalbano | 439/882 |

FOREIGN PATENT DOCUMENTS 2438359 10/1979 France .

*Primary Examiner*—Gary F. Paumen

*Attorney, Agent, or Firm*—Katherine A. Nelson

[57] ABSTRACT

An electrical terminal 10 stamped and formed from a single thickness of metal stock comprises a hollow body portion 12 and a plurality of contact sections 22, 24 extending forwardly therefrom, first and second opposing transition portions 36, 42, and a double layer barrel portion 48. The transition portions 36, 42 coextend rearwardly from respective opposing side sections 14, 16 of hollow body portion 12. The double layer barrel portion 48 includes first and second barrel sections 50, 56, which extends rearwardly from respective first and second transition portions 36, 42, the first barrel section 50 being nested within the second barrel section 56 such that a seam 53 of first barrel section 50 is basically diametrically opposed from a seam 59 of second barrel section 56 and a continuous portion of second barrel section 56 overlies the seam 53 of said first barrel section 50. Upon crimping double barrel portion 48 to a wire member 70, barrel portion 48 simulates a continuous annular body and first and second transition portions 36, 42 provide for improved transmission of current from wire 70 and through terminal 10 without excessive heating. A method for making terminal 10 is also disclosed herein.

21 Claims, 3 Drawing Sheets

ELECTRICAL CONTACT TERMINAL

This application is a continuation of application Ser. No. 07/285,681 filed Dec. 16, 1988, now abandoned.

FIELD OF THE INVENTION

This invention is directed to electrical contact terminals and in particular to electrical contact terminals that may be stamped and formed.

BACKGROUND OF THE INVENTION

In forming power or signal distribution systems, it is necessary to provide interconnections between various members or components of the system. Generally the interconnections are provided by electrical connectors having one or more electrical contact terminals therein.

A major requirement of any connector system is that it be reliable and stable over a life span that may be as long as 10 to 20 years. In many integrated circuit systems there can be no more than a 5 percent voltage drop through the system. Thus each connection can only have a very small percentage of the total drop. It is essential therefore that the connectors be designed to minimize the millivolt drop and to remain stable throughout the life of the system.

With advances in technology, the amount of total termination resistance, which includes a combination of bulk resistance, constriction resistance and crimp resistance, permitted by a system is being reduced and in many systems the total termination resistance is in the magnitude of 10 milliohms or less. It is necessary therefore to design contact members and in particular power contact members that have a very low millivolt drop at each point of termination. In addition, the millivolt drop, which is a function of the resistance of the contact member, should not increase very much over the life of the contact. In order to meet the design requirements, it is necessary to drop the bulk resistance of the contact member as low as possible, lower the "constriction resistance" that is the resistance between the contact points or beams of the contact member and provide a termination to a wire that has a low resistance and is stable.

In designing the mating portion of a power contact member, it is most desirable to use a plurality of spring contact arms which will provide a plurality of parallel paths thus reducing the millivolt droppage of the total contact member. The material selected for the contact, therefore, must be highly conductive yet have sufficient mechanical properties and exhibit sufficient tensile strength that allows beams to be formed having a small cross section and a very low stress relaxation so that the contact beams will continue to exert sufficient normal force over the life of the contact.

U.S. Pat. No. 2,704,358 discloses a contact of the prior art used for power systems having a solid barrel portion, a transition portion and a contact area. The width of the material used in the transition area between contact area and the barrel portion is narrow. The current flowing through this contact area therefore must flow through the narrow transition portion and into the larger body and contact area, thus raising the resistance and thereby the temperature in the transition portion. The very small cross sectional area of the transition portion of the contact terminal in effect may act as a fuse because it can overheat. It is desirable, therefore, to provide a contact terminal or member that will have an essentially constant cross sectional area throughout the length of the terminal.

U.S. Pat. No. 2,535,013 discloses a connector having a crimpable power contact terminal having a solid barrel portion made by brazing the seam of a formed member. Solid barrel terminals may also be made by machining as known in the art. A brazed seam barrel is suitable for terminal members such as those having blade type contact portions or a terminal wherein a wire is bolted to contact portion. The brazed seam barrel, however, is not suitable for the usual contact members having compliant beams. The high temperature required to braze a material having a high conductivity of heat as well as electricity will soften or anneal the metal in the flexible beams contact portion thus removing the resiliency of the beams and reducing the normal force. It is desirable, therefore, to find a means for forming a crimpable barrel connector that will in essence act as a solid member without requiring brazing or joining of the seam or a separate solid sleeve member disposed over the seam.

SUMMARY OF THE INVENTION

In accordance with the present invention, an electrical terminal is disclosed that alleviates the disadvantages and deficiencies of the prior art, can be stamped from a sheet of stock metal, and furthermore provides an electrical contact terminal having a plurality of contact beams for distributing the current.

It is an object of the invention to provide an electrical connector for use with power systems that will be stable and have a low resistance throughout the life of the system.

It is an additional object of the invention to provide a terminal that has a barrel portion that is stamped and formed but has a construction that is essentially equivalent to that of a solid barrel member.

Another object of the invention is to provide a contact terminal that maintains an essentially constant cross sectional area throughout the length of the contact.

A further object of the invention is to provide an electrical terminal having a plurality of contact paths for carrying the current.

It is an additional object of the invention to provide an electrical terminal member that effectively has no open seam.

It is also an object of the invention to provide a cost effective method for making electrical contact terminals having a crimpable barrel section.

The present invention is directed to an electrical contact terminal stamped and formed from a single thickness of metal stock having a hollow body portion and a contact section extending forwardly therefrom, first and second opposing transition portions and a barrel portion. The first and second transition portions coextend rearwardly from respective opposing side sections of the hollow body portion. The barrel portion includes first and second barrel sections which extend rearwardly from respective ones of the first and second transition portions. The first barrel section is nested within the second barrel section such that a seam of the first barrel section is essentially diametrically opposed from a seam of the second barrel section and a continuous portion of the second barrel section overlies the seam of the first barrel section. Upon crimping the barrel portion to a wire member, the barrel portion simulates a continuous angular body, and the first and second transition portions provide for improved transmission of current from the wire and through the terminal without excessive heating.

In accordance with the preferred embodiment of the terminal the contact section comprises a plurality of cantilevered spring contact beams extending forwardly from the hollow body portion. The hollow body portion has rectangular cross section. It is to be understood the cross section of the body portion may have other geometrical shapes such as circular, elliptical, triangular or other polyhedral configurations.

The invention is further directed to a method for stamping and forming the terminal from a single layer of metal stock.

DETAILED DESCRIPTION OF THE DRAWINGS

Figure 1:
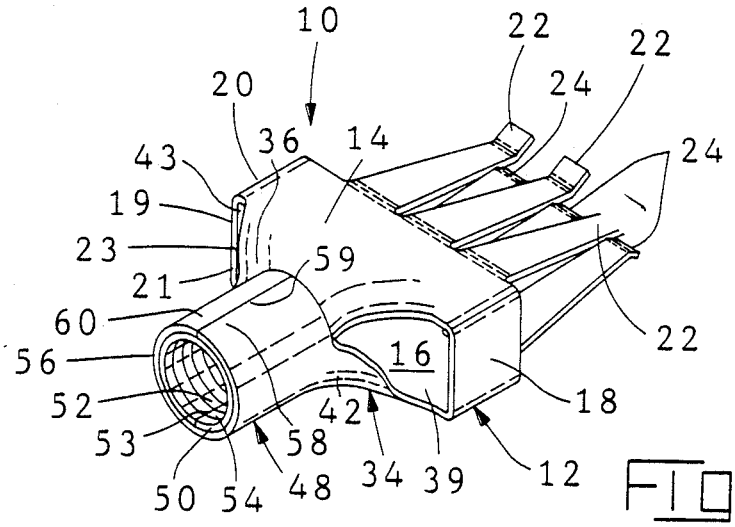
FIG. 1 is a perspective view of the electrical contact member of the present invention.

Referring now to FIGS. 1 through 7, electrical contact terminal member 10 comprises a first body portion 12, transitional body portion 34 and a barrel portion 48. For purposes of illustrating the invention, body portion 12 of terminal member 10 is described as having a rectangular cross section. It is to be understood that the terminal members may have a number of different configurations, and that the hollow body portion may be one having, for example, a cylindrical, elliptical, triangular, rectangular, or any other polyhedral configuration.

Figure 4:
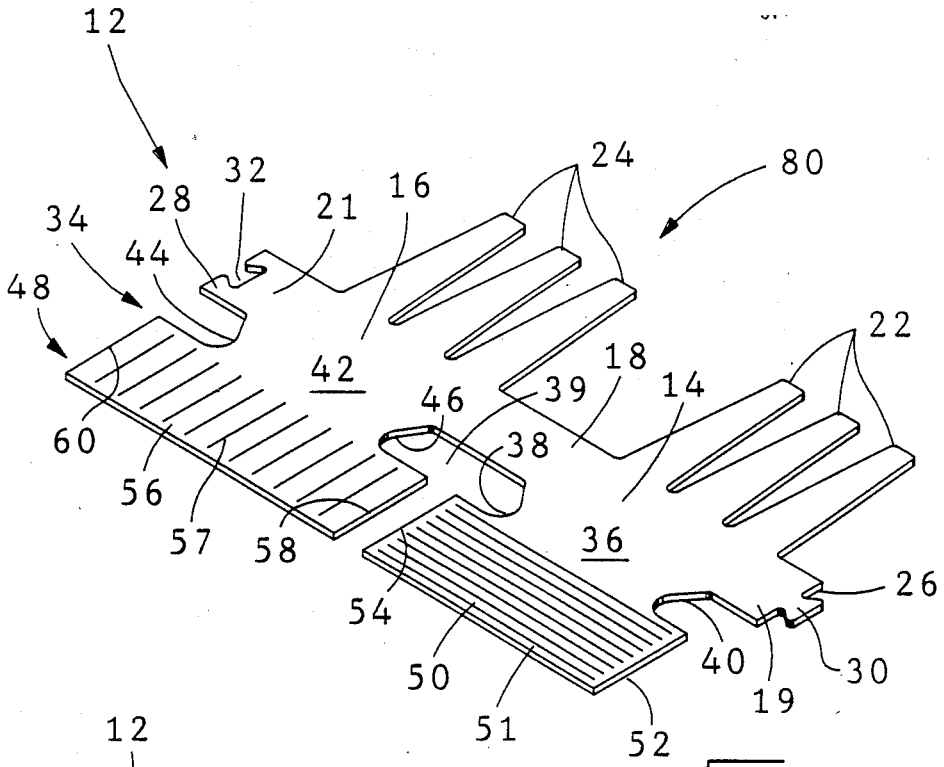
FIGS. 4 through 7 illustrate the steps in making the electrical terminal member in accordance with the present invention.
Figure 5:
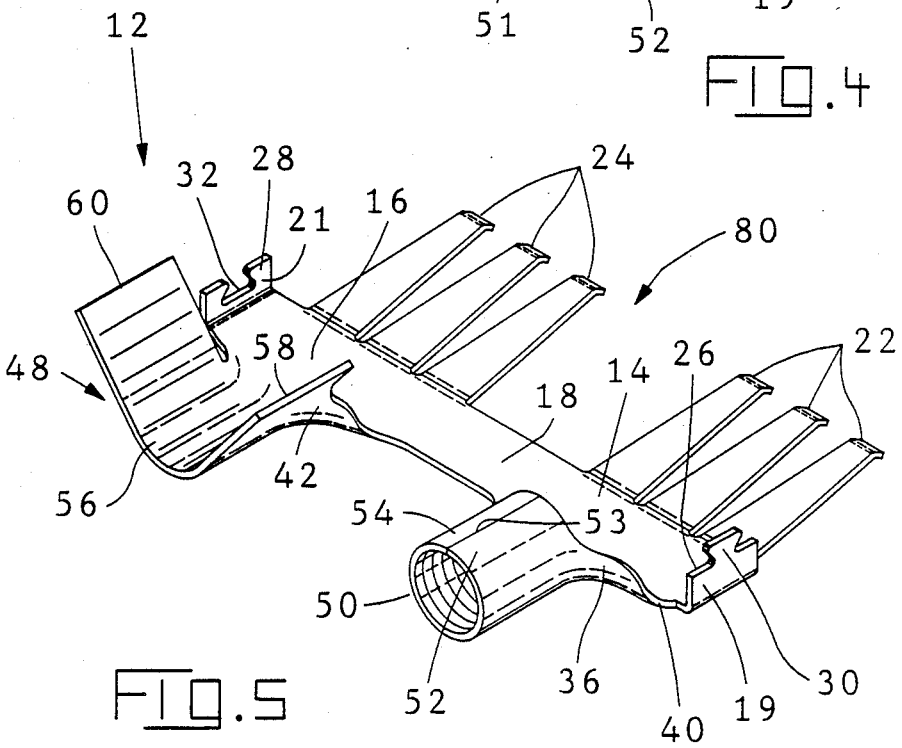
Figure 6:
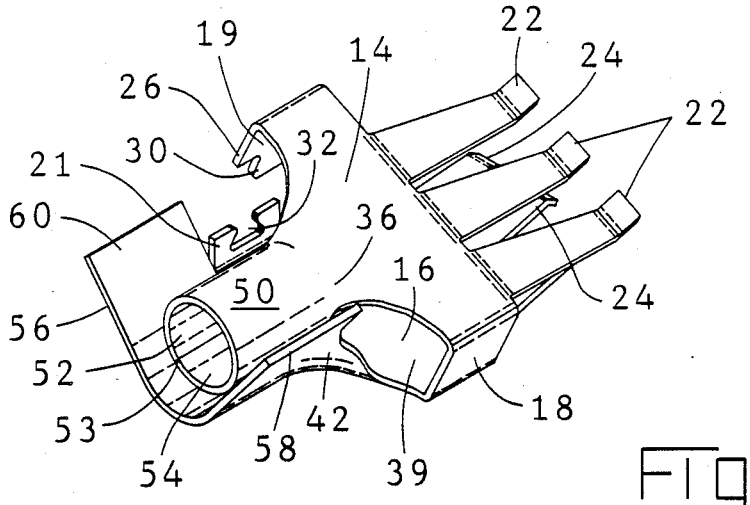
Figure 7:
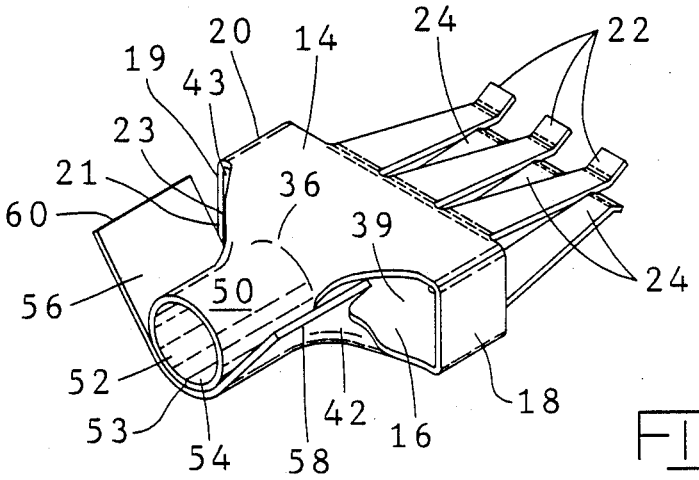

First portion 12 comprises first and second major side sections 14, 16 and minor side sections 18, 20 as best seen in FIGS. 1 and 4. A plurality of first and second spaced cantilevered contact arms or beams 22, 24 extend forwardly from respective first and second major sides 14, 16. As best seen in FIGS. 4 through 6, minor side 20 is formed from two partial side sections 19, 21 respectively which meet at seam 23 along axial edges 26, 28 section 19, 21 respectively. In the preferred embodiment edges 26, 28 include interlocking complementary tab member 30 and slot member 32 respectively for securing edges 26, 28 together. It is to be understood that connector 10 is a representative contact terminal that can be made in accordance with the present invention and that the seam in the first body portion may be secured by other means or need not be secured at all.

Figure 2:
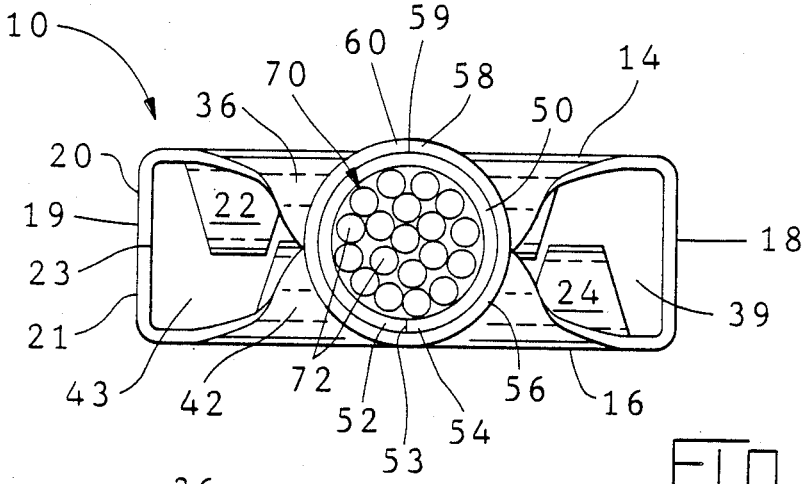
FIG. 2 is a fragmentary cross sectional view of the barrel portion of the contact of FIG. 1 having a conductor member disposed therein.
Figure 3:
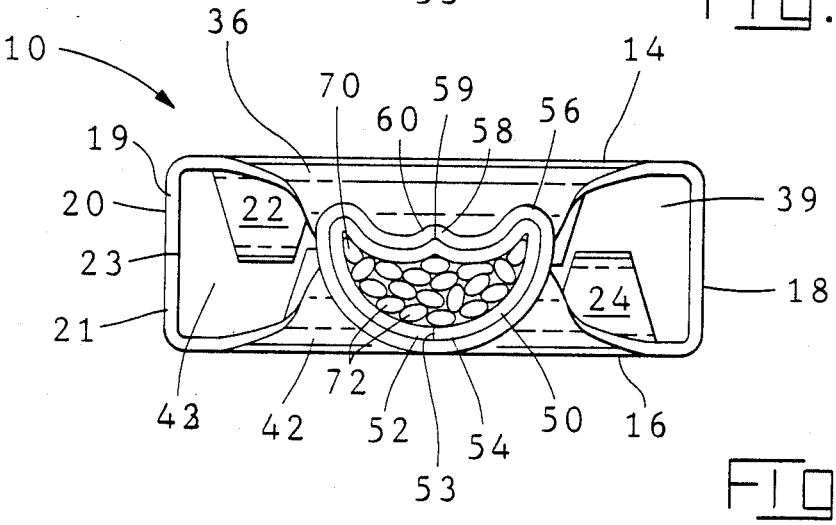
FIG. 3 is fragmentary cross sectional view similar to that of FIG. 2 illustrating the conductor terminated in the terminal barrel portion.

Transition portion 34 comprises first and second transition sections 36, 42 respectively which extend rearwardly from first and second major side sections, 14, 16. As best seen in FIG. 4 the transition sections 36, 42 have inwardly directed sides 38, 40, and 44, 46 respectively. First and second transition sections 36, 42 are essentially equal in width to the cross sectional area extending along the base of contact beams 22, 24 on corresponding major side sections 14 and 16 respectively and rearwardly along sides 14, 16 to respective transition sections 36, 42. In the formed terminal member first and second transition sections 36, 42 are spaced from each other in areas 39, 43 as shown in FIGS. 2 and 3.

Barrel portion 48 is comprised of first and second barrel sections 50, 56. In the assembled terminal 10 first barrel section 50 is nested within second barrel section 56 such that seam 53 formed by abutting edges 52, 54 of first barrel section 50 is essentially diametrically opposite seam 59 formed by abutting edges 58, 60 in the second barrel section 56. By positioning the seams 53, 59 in the two barrel portion sections 50, 56 at a substantial angular distance from each other, such as on opposite sides of the assembled barrel portion 48, the double barrel portion 48 functions essentially as a solid barrel when it is crimped. As is shown in FIGS. 2 and 3, upon insertion of a conductor wire 70 in the barrel 48 and applying crimping force thereto, inner solid barrel portion 50, which is basically aligned with seam 59 of outer or second barrel section 56 and corresponding edges 58, 60 of second barrel 56 are pressed downwardly such that the inner barrel section 50 is subjected to sufficient plastic deformation that it resists springing back to its original shape. The cold welding and plastic deformation in the inner barrel 50 and cold welding between the wire and barrel 50 resist outward movement and essentially eliminate force directed outwardly against the abutting edges 58, 60 of the outer barrel 56 thereby allowing abutting edges 58, 60 to remain in the crimped position. U.S. Pat. No. 2,535,013 discloses the method for making the crimp shown in FIG. 3 and is hereby incorporated by reference herein. FIG. 3 is a cross sectional view of the terminal 10 of the present invention terminated to a wire 70 having a plurality of wire strands 72 therein.

The terminal of the present invention may be used with a wide variety of wire sizes. In general, it is preferred that the cross sectional area of the contact terminal be such that the terminal has the same thermal performance as that of the attached wire. As can be seen in FIGS. 2 and 3, the seam 59 formed by abutting edges 58, 60 of the outer barrel 56 is basically aligned at the center of the crimped section and the center portion of the crimp is plastically deformed preferably below the horizontal axis of the barrel 48 whereby the wire strands 72 are forced into the two sections 64, 66 forming a "B" shape. The crimping force causes cold welding to occur between the internal surface of first or inner wire barrel portion 50 and wire strands 72, which further aid in retaining the wire barrel 48 in its crimped position. In accordance with the present invention, it is preferable that the seam 59 of the outer barrel 56 be aligned essentially at the center of the crimped area to maximize cold welding at the seam, otherwise the abutting edges 58, 60 of the outer barrel 56 will be subjected to undue stress and expand outwardly. The crimp shown in U.S. Pat. No. 2,535,013 is designed to be used with a single annular ring such as a solid screw machined part or a formed member having a brazed seam. When the barrel is crimped it is subjected to sufficient pressure that the outer surface undergoes plastic deformation and is essentially locked into place and does not stress relax enough to affect the function of the crimped barrel. This "locking" was heretofore achieved only with solid rings. In accordance with the present invention, however, the inner seamed ring is subjected to a similar plastic deformation as is a single layer solid ring, thus the inner ring will not stress relax as long as the outer ring is held closed by the cold welding around the seam.

As was previously discussed, a contact terminal having compliant beams of the type shown in FIG. 1, cannot be easily soldered, brazed or welded along that outer seam since the high heat carrying capacity of the heavy metal terminal body will carry the heat away from the seam, thus subjecting the flexible cantilevered beams to a sufficient temperature to soften or anneal the metal thereby removing the flexibility of the beams and destroying their function.

In order to assure that parallel paths are provided for the current, it is important that there be an equally low resistance between the inner barrel portion 50 and the outer barrel portion 56 as there is between the wire 72 and the inner barrel portion 50. It is important, therefore, that all surfaces of the inner and outer barrel members 50, 56 remain in physical and electrical engagement so that a equal resistance is presented by inner and outer sections 50, 56 of the barrel portion 48 and through the transition sections 36, 42 to the contact areas 22, 24. Since electricity will always follow the path of least resistance, the alternative paths through the two transition areas 36, 42 would essentially provide equally available paths for the electricity. One such way of assuring good engagement between the respective barrel surfaces is to put a plurality of serrations 57 on at least one of the surfaces of the barrel portions 50, 56 that are in engagement with each other as shown in FIGS. 4 and 5. Preferably serrations 57 run axially on outer barrel portion 56 to provide a plurality of contact surfaces between barrel portions 50, 56. In addition the inner surface of inner barrel portion 50 may also include serrations 51 for assuring better cold welding of wire strands 72 in barrel portion 50. For ease of manufacturing serrations 57 are preferably put on the inner surface of the outer barrel 56.

Figure 8:
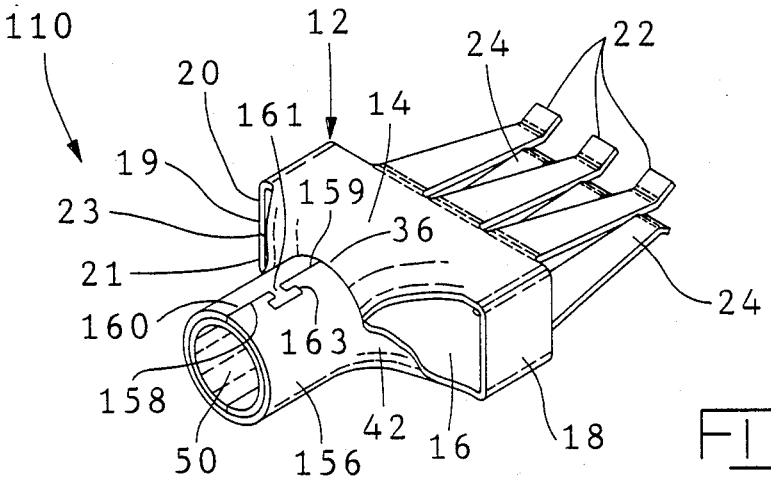
FIG. 8 is an alternative embodiment of the electrical contact terminal member of the present invention.

A further way of assuring that the outer barrel 56 stays in mechanical and electrical engagement with the inner barrel 50 is to provide a means for securing the edges of the outer barrel to each other without requiring braising, welding or other means that could damage the remainder of the contact. As shown in FIG. 8, alternative embodiment 110 of the contact terminal member includes key member 161 and dovetail slot 163 on edges 158, 160 of the outer barrel portion 56, which are securable together to assure that the outer barrel 56 will not "open" during the life of the terminal 110.

Again, since the material for the contact is a good conductor of electricity and also of heat, solder is not usable as a method for securing a wire to such a terminal since the terminal would carry away the heat from the solder joint. In addition to assuring that the outer barrel remains in contact with the inner barrel by means of the locking arrangement, the locking arrangement also eliminates the need to orient the terminal within the crimping tool since there is no "potentially open" seam that needs to be at the precise center of the crimped area as shown in FIGS. 2 and 3.

The present invention also provides a means for assuring that parallel contact paths will be presented for the current to flow from the wire 70 through either the inner barrel portion 50 and first transition portion 36 or the outer barrel portion 56 and second transition portion 42 to the first and second contact arms 22, 24 respectively. The present invention therefore eliminates the "fuse-like" transition portion of the prior art.

FIGS. 4 through 7 illustrate the steps in making the invention as shown in FIG. 1. Preferably the connectors 10 are made from a continuous strip of metal in which a plurality of terminal blanks 80 as shown in FIG. 4 are stamped from the strip such that blanks extend and are spaced along a carrier strip (not shown). The terminal 10 is formed from blank 80 by first forming inner wire barrel portion 50 into a ring and second or outer barrel portion 56 into a U-shaped member as shown in FIG. 5. The partially formed terminal blank 80 is then rolled or formed into hollow body portion 12 such that edges 26, 28 of minor side portions 19, 21 of terminal 10 are brought into alignment to form minor side 20, and concomitantly therewith formed inner barrel portion 50 is received in the open "U" shaped outer barrel portion 56. Outer barrel portion 56 is then closed to form the terminal 10 of the present invention as shown in FIG. 1.

In making power contacts of this type, it is necessary to use a material that has a high conductivity, but in addition has a low stress relaxation and adequate yield strength to exert sufficient normal force in the contact areas of the cantilevered beams. While pure copper is a suitable metal for terminal members of the blade type wherein a formed member can be brazed, generally it is not suitable for terminal members having flexible portions in that the copper will stress relax over time thus causing a drop in the amount of current which can be carried by the terminal. The stress relaxation characteristics of pure copper would cause the normal force to be reduced by as much as 50% over the life of the terminal member. It is desirable, therefore, to use a material having a high conductivity and very good mechanical properties. The material should have a sufficiently high tensile strength such that a beam having a small cross section can be formed and the material further should have very low stress relaxation characteristics over a period of time. Suitable material include copper alloys, such as Olin C-151 available from Olin Brass, East Alton, Ill., C-151 has 85–95% of the conductivity of pure copper yet retains very good mechanical properties such as tensile strength, and low stress relaxation properties so that a crimp will remain closed over the lifetime of the contact. It is to be understood that the strip of material need not be made from a single metal or metal alloy. Terminals can be made from strips formed of two metals welded together such that for instance the compliant beams may be made of one material and the remaining portions be made of a second material.

The present invention provides an electrical terminal member that may be used for power connections, that has a plurality of contact beams to decrease the resistance of the contact, a barrel portion that is crimpable to wires and one having at least two transition areas such that at least two parallel conductive paths are created to distribute the current through the contact and prevent the "fuse effect" of prior art terminals.

The contact terminal of the present invention is intended to be mated with a complimentary terminal member such as a box-like or blade-like member receivable between the compliant beams, or a box-like member which receives the plurality of cantilevered beams therein.

The electrical contact terminal as disclosed herein and shown in the accompanying Figures, provides a terminal that can be manufactured in a cost effective stamped and formed manner, and permits the use of many grades of materials and combinations of materials as long as the selected material gives the desired amount of conductivity needed for low termination resistance and has the proper mechanical properties to minimize stress relaxation in the beam area. The electrical terminal of the present invention further includes additional cross sectional area in the crimp portion and throughout the transition area which provides for parallel paths for current. In addition the double layer barrel portion adds bulk thus permitting crimping in a manner that is equivalent to crimping a continuous annular barrel member without the need for welding or brazing and gives a stable crimp with a minimum of constriction resistance.

It is thought that the electrical contact terminal of the present invention and many of its attendant advantages will be understood from the foregoing description. Changes may be made in the form, construction and arrangement of parts thereof without departing from the spirit and scope of the invention or sacrificing all of its material advantages.

We claim:

1. An electrical terminal stamped and formed from a single thickness of metal stock, comprising:

a hollow body portion and a contact section extending forwardly therefrom;

first and second opposing transition portions coextending rearwardly from respective opposing side sections of said hollow body portion; and a barrel portion including first and second barrel sections extending rearwardly from respective ones of said first and second transition portions, said first barrel section being nested within said second barrel section such that a seam of said first barrel section is essentially diametrically opposed from a seam of said second barrel section and a continuous portion of said second barrel section overlies said seam of said first barrel section, said barrel portion thereby having two thickness of metal therearound; whereby upon crimping said barrel portion to a wire member, said barrel portion simulates a continuous annular body and said first and second transition portions provide for improved transmission of current from said wire and through said terminal without excessive heating.

2. The electrical terminal of claim 1 wherein said body portion has a plurality of contact sections extending forwardly therefrom.

3. The electrical terminal of claim 2 wherein said plurality of contact sections comprise cantilevered beams.

4. The electrical terminal of claim 1 wherein said hollow body portion has a rectangular cross section.

5. The electrical terminal of claim 1 wherein said barrel portion is crimped to a wire member.

6. The electrical terminal of claim 5 wherein the center of said crimp is plastically deformed to a position below a horizontal axis of said barrel portion.

7. The electrical terminal of claim 1 further including locking means along said seam of said outer barrel section to secure edges of said seam together.

8. The electrical terminal of claim 1 further including a plurality of serrations on the inner surface of said outer barrel section, said serrations extending axially along said outer barrel section.

9. The electrical terminal of claim 1 further including a plurality of radially extending serrations on the inner surface of said barrel section.

10. An electrical terminal stamped and formed from a single thickness of metal stock, comprising:

a hollow body portion having opposed first and second major side sections and opposed first and second minor side sections;

at least one contact member extending forwardly from each of said first and second major side sections;

first and second transition portions extending rearwardly from respective said first and second major side sections; and a barrel portion including first and second barrel sections extending rearwardly from respective ones of said first and second transition portions, each of said first and second barrel sections having a seam extending axially therealong, said first barrel section being nested within said second barrel section such that said seam of said first barrel section is essentially diametrically opposite the seam of said second barrel section, said barrel portion thereby having two thickness of metal; whereby upon crimping said barrel portion to a wire member, said barrel portion acts as if it were a continuous annular body and said first and second transition portions provide for improved transmission of current from said wire and through said terminal without excessive heating.

11. The electrical terminal of claim 10 wherein said body portion has a plurality of contact sections extending forwardly therefrom.

12. The electrical terminal of claim 11 wherein said plurality of contact sections comprise cantilevered beams.

13. The electrical terminal of claim 10 wherein said hollow body portion has a rectangular cross section.

14. The electrical terminal of claim 10 wherein said barrel portion is crimped to a wire member.

15. The electrical terminal of claim 14 wherein the center of said crimp is plastically deformed to a position below a horizontal axis of said barrel portion.

16. The electrical terminal of claim 10 further including locking means along said seam of said outer barrel section to secure edges of said seam together.

17. The electrical terminal of claim 10 further including a plurality of serrations on the inner surface of said outer barrel section, said serrations extending axially along said outer barrel section.

18. The electrical terminal of claim 10 further including a plurality of radially extending serrations on the inner surface of said inner barrel section.

19. A method for making an electrical terminal from a single thickness of metal stock comprising the steps of:

selecting a metal stock having the desired properties;

stamping a terminal blank from said stock, said blank having a forward portion adapted to be formed into at least one contact section, a first intermediate section extending from said forward section and adapted to be formed into a hollow body portion, a second intermediate portion adapted to be formed into first and second transition portions extending rearwardly of said first intermediate section, and first and second rearward portions adapted to be formed into first and second barrel sections extending rearwardly from respective said first and second transition portions;

forming said first rearward portion into said first barrel section;

partially forming said second rearward portion into a U-shaped member;

forming said first intermediate portion into said hollow body portion of said terminal such that said formed first barrel section is nested within the U-shaped member; and forming said U-shaped member into an outer barrel section such that a seam of said first barrel is essentially diametrically opposed from a seam of said second barrel section and a continuous portion of said second barrel section overlies said seam of said first barrel section.

20. The method of claim 19 further providing a plurality of serrations on inner surfaces of said first and second rearward sections.

21. A wire-receiving barrel terminal having an inner barrel and an outer barrel, each barrel having a seam, the seams of said inner and outer barrels being a substantial angular distance from each other and each seam being adjacent a continuous wall section of the other barrel whereby upon crimping the terminal to an end of a wire conductor, no opening occurs through the circumference of the barrel terminal.

* * * * *